US006111155A

United States Patent [19]

Williams et al.

[11] Patent Number: 6,111,155

[45] **Date of Patent: *Aug. 29, 2000**

[54] METHOD OF PRODUCING GAS HYDRATE IN TWO OR MORE HYDRATE FORMING REGIONS

[75] Inventors: Andrew Richard Williams, Hinckley; Trevor Smith, Whitley Bay, both of United Kingdom

[73] Assignee: BG PLC, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/913,412

[22] PCT Filed: Jan. 7, 1997

[86] PCT No.: PCT/GB97/00021

§ 371 Date: Oct. 7, 1997

§ 102(e) Date: Oct. 7, 1997

[87] PCT Pub. No.: WO97/26494

PCT Pub. Date: Jul. 24, 1997

[30] Foreign Application Priority Data

Jan. 18, 1996 [GB] United Kingdom ..... 9601030

[51] Int. Cl.[7] ..... C07C 7/20

[52] U.S. Cl. ..... 585/15

[58] Field of Search ..... 585/15

[56] References Cited

U.S. PATENT DOCUMENTS

| | | | |
|---|---|---|---|
| 2,356,407 | 8/1944 | Hutchinson | 48/190 |
| 2,399,723 | 5/1946 | Crowther | 585/15 |
| 2,410,583 | 11/1946 | Huchinson | 585/15 |
| 2,528,028 | 10/1950 | Barry | 585/15 |
| 2,904,511 | 9/1959 | Donath | 210/711 |
| 2,943,124 | 6/1960 | Wilson | 585/15 |
| 2,974,102 | 3/1961 | Williams | 210/711 |
| 3,354,663 | 11/1967 | Hendrix | 62/633 |
| 4,393,660 | 7/1983 | Kleiner et al. | 62/69 |
| 4,920,752 | 5/1990 | Ehrsam | 62/46.1 |
| 5,536,893 | 7/1996 | Gunmundsson | 585/15 |
| 5,660,603 | 8/1997 | Elliot et al. | 48/127.5 |

FOREIGN PATENT DOCUMENTS

WO 93/01153 A1 1/1993 WIPO .

*Primary Examiner*—Walter D. Griffin
*Assistant Examiner*—Nadine Preisch
*Attorney, Agent, or Firm*—Larson & Taylor PLC

[57] ABSTRACT

A process for producing natural gas hydrate comprises three states (i), (ii), and (iii). State (i) comprises three pressure vessels (A1, A2, and A3), stage (ii) two pressure vessels (A4 and A5), and stage (iii) the pressure vessel (A6). The conditions of temperature and pressure in the pressure vessels are such that the gas hydrate is formed in the vessels. The formed hydrate is taken off through pipes (e1, e2, e3, e4, e5, and e6) from the pressure vessels to a manifold (34). Chilled water which is both the reactant water and coolant for the process is provided by cooling means (20) and supplied simultaneously to the lower part of each pressure vessel via pipe (22), manifold (32) and pipes (b1, b2, b4, b5, and b6). Natural gas from supply (26) is fed via pipe (30), manifold (32) and pipes (c1, c2, and c3) to nozzles in the lower part of each vessel (A1, A2, and A3) from which nozzles the gas bubbles upwards through the columns of water in vessels (A1, A2, and A3). Unreacted gas is fed from vessels (A1, A2, and A3) to similar nozzles in the vessels (A4 and A5) from which unreacted gas is fed to a nozzle in the vessel (A6) from which the unreacted gas is taken off through pipe (d6). The mean upward superficial velocity of the gas is substantially the same in all three stages.

22 Claims, 5 Drawing Sheets

(i)
(ii)
(iii)
d1
A1
e1
d4
76
80
78
c1
d6
26
A4
e4
b1
c4
38
36
c6
A6
34
24
d2
b4
d5
28
A2
e2
c2
30
32
e5
b2
c5
A5
b5
b6
d3
37
e3
A3
c3
b3
22
42
40
20
54
39
60
58
62
42
52
50
48
46
74
72
68
66
64
70

14
12
d6
80
16
86
84
(n)
10
4'
86
82
32'
(n-1)
10
34
84
(iii)
4'
37
82
(ii)
86
84
4'
24
82
86
(i)
30
4
22
84

METHOD OF PRODUCING GAS HYDRATE IN TWO OR MORE HYDRATE FORMING REGIONS

This invention relates to a method of producing gas hydrate from an hydrate forming gas.

The hydrate forming gas may be substantially a single gaseous substance, or the hydrate forming gas may comprise a mixture of hydrate forming gaseous substances, for example natural gas.

A gas hydrate is an ice-like crystal structure comprising mainly water molecules and during the formation of the hydrate the gas molecules are incorporated into molecular scale cavities within the crystal structure. A unit volume of typical hydrate can contain in excess of 100 volumes of gas when the gas is measured at 20° C. and atmospheric pressure.

Hydrates can only be formed by a limited range of gaseous compounds including methane, ethane, propane, butane, carbon dioxide, hydrogen sulphide, tetra-hydro furan, and chlorofluorocarbons. The first six of these gaseous compounds form the bulk of most natural gas fields.

FIG. 1 of the drawings shows a calculated hydrate equilibrium curve for a typical North Sea natural gas composition, in which the curve represents the pressure and temperature conditions at which the natural gas hydrate forms. Thus gas hydrate forming conditions for this particular natural gas are when it is at pressure and temperature values which are either on the curve or to the left-hand side of the curve. The natural gas to which FIG. 1 relates is of the following composition or mixture of gaseous substances in mol %:

| Gaseous Substance | mol % |
|---|---|
| Nitrogen | 2.07 - reluctant to form hydrate |
| Carbon Dioxide | 0.575 - forms hydrate |
| Methane | 91.89 - forms hydrate |
| Ethane | 3.455 - readily forms hydrate |
| Propane | 0.900 - easily forms hydrate |
| Butane | 0.395 - easily forms hydrate |
| Pentane | 0.177 - non-hydrate former |
| Hexane | 0.0108 - non-hydrate former |
| Heptane | 0.0105 - non-hydrate former |
| Octane | 0.0102 - non-hydrate former |
| Water | 0.5065 - non-hydrate former |

Under appropriate conditions of pressure and temperature known to those skilled in the art the mixing of a hydrate forming gas with water results in the formation of the gas hydrate.

According to the invention a method of producing a gas hydrate from an hydrate forming gas comprises passing the gas into an hydrate forming region in which hydrate of the gas is formed and passing residual gas which has not formed hydrate in said region from said region into at least one other hydrate forming region in which hydrate of said gas is formed.

The invention will now be further described, by way of example, with reference to the accompanying drawings in which.

Figure 1:
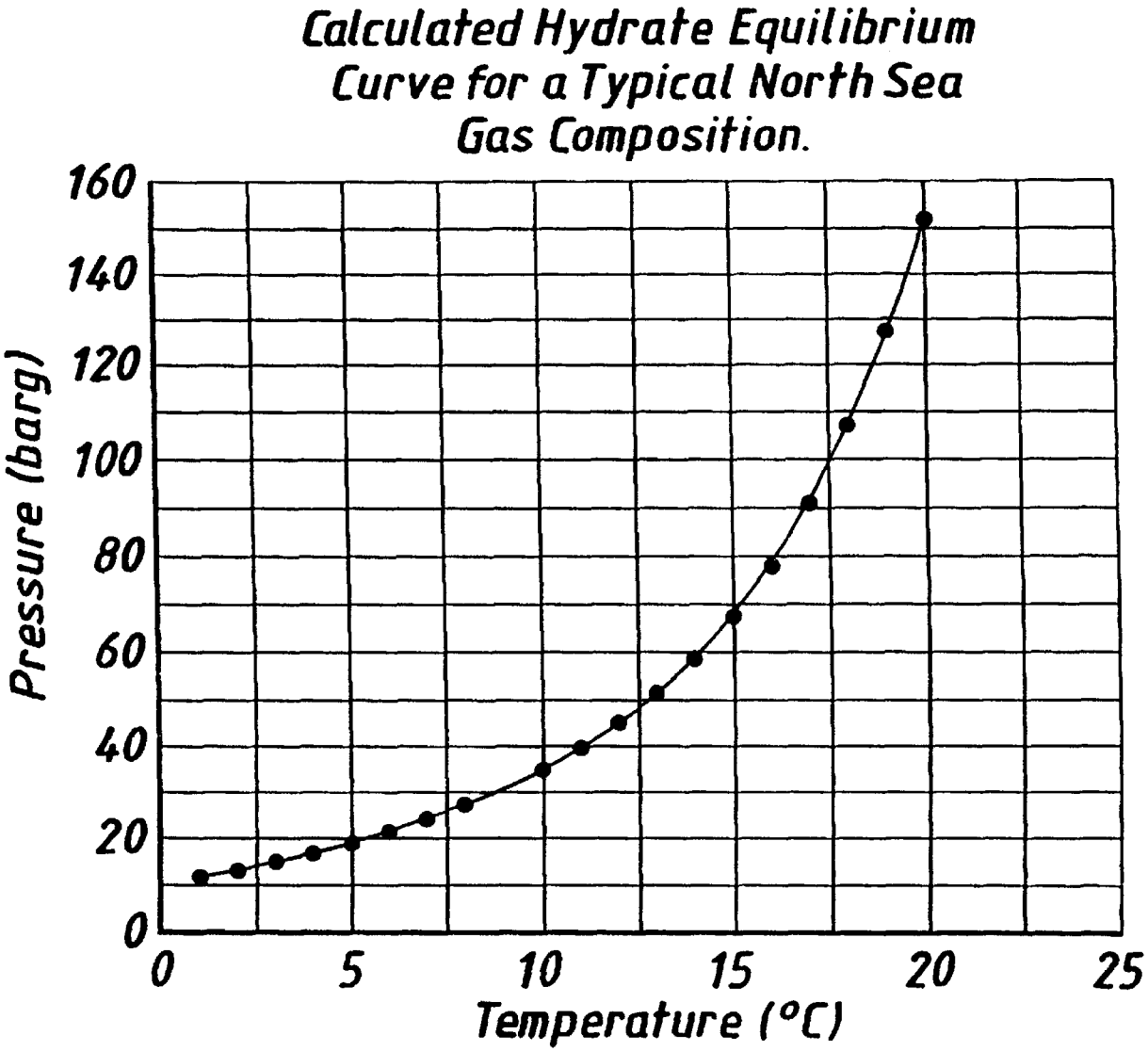

In the drawings like reference numerals or letters identify similar or comparable parts. Also the drawings have been simplified by omitting therefrom certain flow direction control valves, fluid pressure control valves and pumps which the skilled addressee will readily be able to provide to operate the plant.

Figure 2:
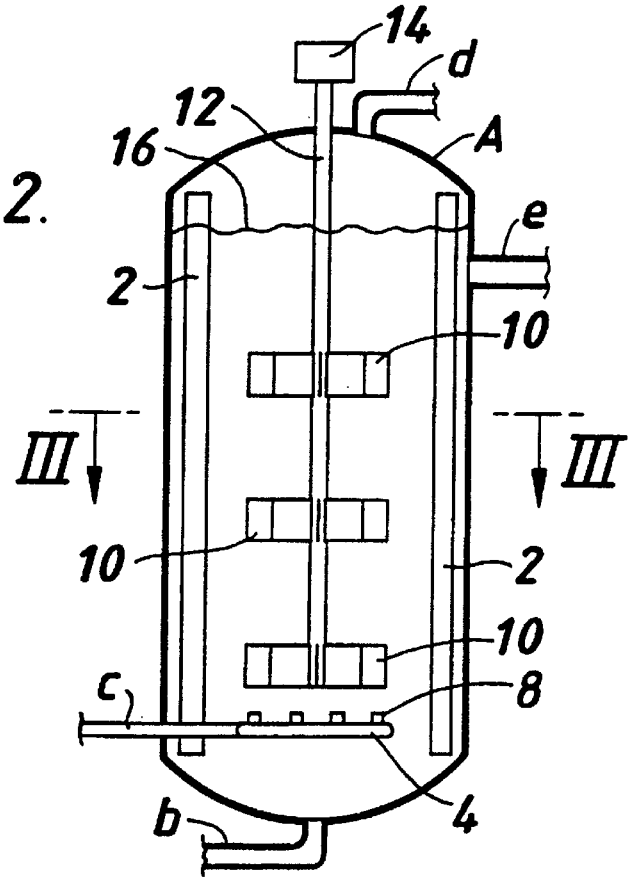
FIG. 2 is a diagramatic section of a pressure vessel used in the method according to the invention.
Figure 3:
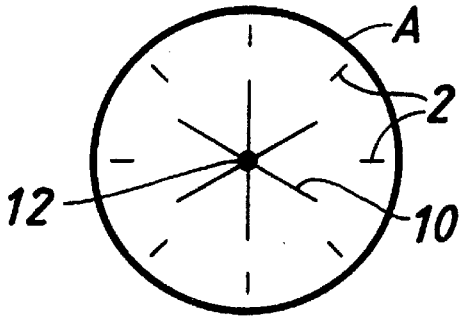
FIG. 3 is a diagramatic section on line III—III in FIG. 2.
Figure 4:
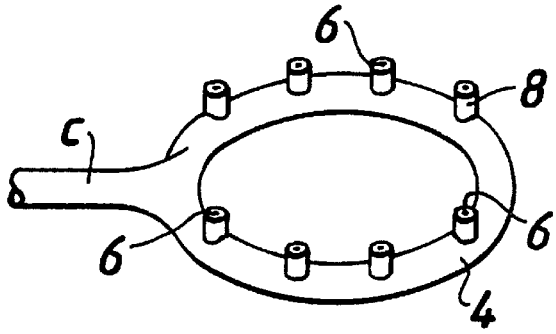
FIG. 4 is a perspective view on a larger scale than FIG. 2 of a gas distribution nozzle used in the pressure vessel in FIG. 2.

With reference to FIGS. 2 to 4 a pressure vessel or chamber A of generally cylindrical shape has a plurality of substantially radially disposed baffle plates 2 extending along the interior of the vessel and spaced from an interior wall of the vessel. Leading into a bottom or a lower part of the vessel A is a water inlet pipe b. Adjacent to the bottom of the pressure vessel A is a gas supply nozzle 4 fed by a gas supply pipe c supplying hydrate forming gas, for example natural gas, to the nozzle from which the gas ascends from nozzle holes 6 in nipples 8 as streams of small bubbles through the column of water above the nozzle. The vessel also includes mechanical agitating means driven, preferably continually, to agitate the water column and the forming hydrate therein. The mechanical agitating means are exemplified in FIGS. 2 and 3 by a plurality of rotors 10 at different positions along the height of the vessel, each rotor comprising a plurality of paddles rotated by a shaft 12 driven by a motor 14. At or adjacent to the top of the vessel A is a gas outlet pipe d through which the unreacted or excess gas which has not formed hydrate is taken off. An outlet pipe e adjacent to the upper end of the vessel A is for taking off, substantially continuously, the formed gas hydrate which may be in slurry form. The upper surface of the hydrate is represented at 16.

The pressure within the pressure vessel A may be in the range of about 10 barg to about 200 barg. The water introduced via pipe b is preferably chilled water and can be at a temperature in the range of substantially +5° C. to substantially −20° C., preferably substantially +2° C. to substantially −1° C. The water and gas are each introduced into the vessel A under pressures comensurate with that prevailing in the vessel. The formation of hydrate is an exothermic reaction so there is a tendancy for the temperature of the water column to rise. For example the slurry under pressure leaving through the pipe e may be at a temperature of about 6° C. which may be about 5° C. higher than that of the water being supplied through pipe b. But the substantially continuous supply of chilled water keeps the temperature in the vessel A down to a desired value and avoids the need to provide cooling means or devices within the vessel A or around its exterior.

After the slurry has been extracted through the outlet pipe e it can be processed to remove excess water from the slurry to leave the gas hydrate material more concentrated. That excess water can be re-circulated or returned to the pressure vessel A, for example after make-up water is added to said excess and the combination cooled so that the returned water can again act both as a coolant for the hydrating process and as the reaction liquid therein.

If desired one or more additives may be added to the water to lower the freezing point of the water which is contacted with the gas for cooling and reaction purposes. This additive can be one or more inorganic salts added by means of using seawater as feed water to the process.

Dissolved inorganic salts are not incorporated into produced hydrate and recirculation of the reaction/cooling liquid would thus lead to a build up of these compounds to form a concentrated brine. The degree of concentration may be adjusted as necessary by the removal of a flow of concentrated brine from the recirculating volume.

Alternative additives may be other inorganic salts used in refrigerant brines, for example calcium chloride or certain organic compounds, for example alcohols and glycols.

We have observed that the use of such additives confers the following advantages for hydrate manufacture:

(1) The freezing point of water is generally lowered more by the presence of such additives than the maximum hydrate formation temperature is lowered. This increases the range of operating temperature for the process which can be utilised either to increase the hydrate production rate or to reduce the cooling water flow required.

(2) The changes in gas-liquid interfacial surface properties caused by the presence of such additives can enhance the hydrate production rate.

(3) The lower freezing point of the liquid exiting the pressure vessel allows cooling of this liquid, and the hydrate which it contains, to a temperature close to that desired for the long term storage or transportation of the hydrate. Those knowledgeable in the art of heat transfer will appreciate that the cooling of such a slurry is achieved with less inconvenience and expense than that of a solid.

(4) Certain of the additives will increase the density of the liquid. This will aid later separation of the produced hydrates.

Figure 5:
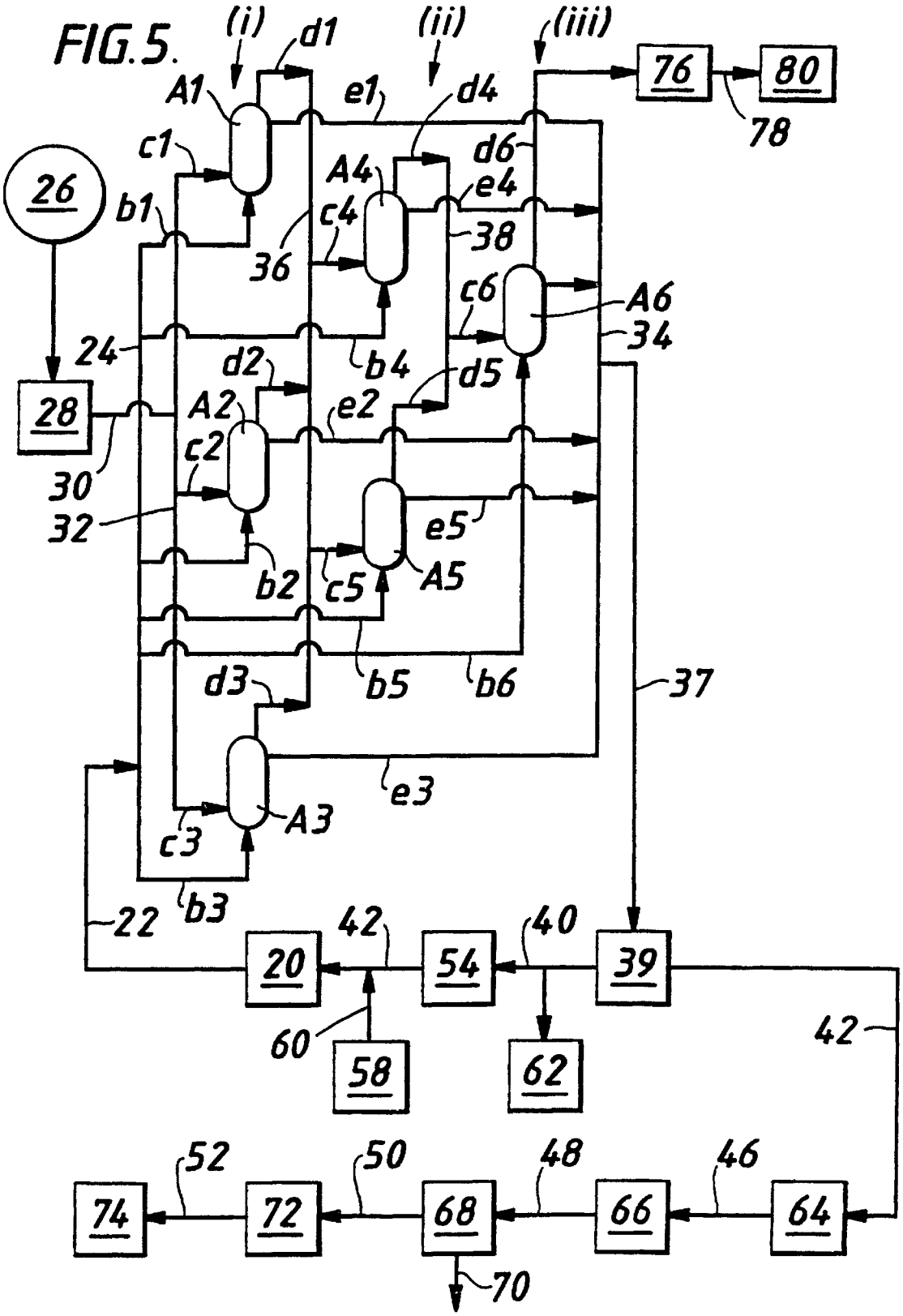
FIG. 5 shows diagramatically a plant for forming gas hydrate by the method according to the invention using a plurality of pressure vessels each of the kind in FIG. 2.

In the natural gas hydrate forming plant in FIG. 5, there are a plurality of successive hydrate forming stages exemplified in FIG. 5 by a stage(i), a stage(ii), and a stage(iii). Stage(i) comprises three pressure vessels A1, A2 and A3, stage(ii) comprises two pressure vessels A4 and A5, and stage(iii) comprises one pressure vessel A6. There are at least two successive stages and each stage may comprise one or more pressure vessels. The vessels A1 to A6 are of substantially the same type as the vessel A in FIGS. 2 to 4.

Chilled water from water cooling means 20 is substantially continuously supplied through pipe 22 and manifold 24 to water inlet pipes b1, b2, b3, b4, b5 and b6 supplying the respective pressure vessels separately and simultaneously.

Hydrate forming gas, for example natural gas, from a supply 26 is fed to processing station 28 where the gas is pre-processed, for example cleaned or filtered or cooled and then supplied, under appropriate pressure, by pipe 30 to a manifold 32 simultaneously feeding three gas supply pipes c1, c2 and c3 supplying the vessels A1, A2 and A3 respectively. The gas hydrate in slurry form is extracted from the vessels A1, A2 and A3 substantially continuously through a respective outlet pipe e1, e2 or e3 feeding a manifold 34. Un-reacted gas leaves the first stage(i) vessels through outlet pipes d1, d2 and d3 supplying that gas to manifold 36 from which the gas is supplied to gas supply pipes c4 and c5 respectively feeding the pressure vessels A3 and A4 of stage(ii). Gas hydrate slurry from stage(ii) is supplied to the manifold 34 through outlet pipes e4 and e5 and the un-reacted gas from stage(ii) is supplied through outlet pipes d4 and d5 to a manifold 38. From manifold 38 the un-reacted gas from stage(ii) is supplied to the pressure vessel A6 through inlet pipe c6. Gas hydrate slurry from the vessel A6 is supplied to the manifold 34 through outlet pipe e6 and un-reacted gas from stage(iii) is conveyed off through outlet pipe d6.

The pressure in the vessels of stage(i) may be greater than that in the vessels of stage(ii) which in turn may be greater than that in the vessel of stage(iii). For example the pressure difference between two aforesaid stages may be of the order of 0.5 or 1.0 barg. In the vessels A1, A2 and A3 of stage(i) the pressure may be, for example, substantially 100 barg, the pressure in the vessels A4 and A5 of stage(ii) may be, for example, substantially 99 barg, and the pressure in the vessel A6 of stage(iii) may be, for example, substantially 98 barg.

We believe that by maintaining the mean superficial upward velocity of the gas substantially the same in all the stages, this leads to a more efficient bulk conversion of the gas to solid hydrate. The mean superficial velocity of the gas is the flow rate of the gas through the pressure vessels of a particular stage divided by the total cross-sectional area of those vessels. Because gas is consumed in stage(i) the gas flow rate becomes less through the vessels A4, A5 of stage(ii). Thus to maintain the mean superficial velocity of the gas in stage(ii) substantially the same as that in stage(i) the total cross-sectional area of the vessels A4 and A5 has to be less than the total cross-sectional area of the vessels A1, A2 and A3 of stage (i). Similarly because gas is consumed in stage(ii), the gas flow rate in stage(iii) is less than in stage(ii) and thus to maintain the mean superficial velocity of the gas through the vessel A6 substantially the same as that velocity through the previous stages, the cross-sectional area of the vessel A6 is less than the total cross-sectional area of the second stage(ii) vessels A4 and A5. The mean superficial velocity of the gas may be substantially constant.

In certain prior art plant using a single pressure vessel we believe that the reduction of gas flow, expressed as a mean superficial upward velocity, caused by the bulk conversion of gas to solid hydrate leads to a very inefficient use of the pressure vessel volume in the late stages of the hydrate forming reaction, resulting in the need for large vessel volume and causing increased cost. A standard engineering solution would be to recycle unconverted gas leaving the vessel and re-inject it into the base of the vessel to increase average superficial velocity. This requires expensive compression and piping equipment and increases overall pressure drop and energy consumption.

We provide an innovative solution which is to divide the reaction process into a series of separate successive stages in which the total horizontal cross-sectional area presented to the rising gas and water flow is progressively reduced from one stage to the next in succession.

The plant disclosed in FIG. 5 has the advantage as follows.

(5) When the feed gas contains a proportion of non-hydrate forming gaseous substances or less readily hydrate forming gaseous substances (hereinafter refered to collectively as non-hydrate forming gaseous substances) it is known that the rate of hydrate formation is reduced in proportion to the total non-hydrate forming gaseous substances fraction. The non-hydrate forming gaseous substances will progressively form a higher proportion of the bubbles as hydrate forming gaseous substances are consumed. This will slow the reaction rate but cannot be avoided if efficient conversion of the feed gas to hydrate is desired. Production of hydrate in a series of stages effectively limits this reduction of reaction rate to the final pressure vessel(s) as only in this stage of the process has the proportion of non-hydrate forming gaseous substances reached a significant level.

(6) The staged pressure vessel scheme in FIG. 5 permits the supply of water to and the removal of water and hydrate from each pressure vessel to be manifolded as shown in FIG. 5, with separate pipes b1 etc. supplying cool water from the common supply 22 to the base of each vessel, and the pipes d1 etc removing liquid and hydrate from each vessel to pass to the manifold 34. Gas flow through this scheme is via the series of pipes c1 etc., d1 etc. This scheme can reduce the flow of water up through each vessel to that required for removing the heat from reaction in that vessel alone. Similarly the hydrate in each pipe e1 etc. is limited to that produced by reaction in each vessel alone. In certain known single pressure vessel schemes we have found that water and hydrate flows can be so high as to interfere with the efficient mixing and contacting of water and gas necessitating an overly large reaction volume to be provided.

From the manifold 34 the hydrate slurry is supplied through piping 37 to primary separation means 39 known per se for separating the hydrate from excess water. Further piping is indicated at 40, 42, 44, 46, 48, 50 and 52. The pressures prevailing in the piping 37, 40 and 42 are substantially the same high pressure as that in the pressure vessel A6 of reaction stage(iii). The separated water which may contain unseparated hydrate is pumped by pressure boosting means 54 via the cooling means 20 back to the pressure vessels A1 to A6. Additional make-up water, and optionally additive, may be added via pump means 58 and piping 60 to the water being re-circulated. If desired water extraction means 62 may remove a portion of the stream of water from the separation means 39 so that the concentration of additive in the water being supplied to the process vessels can be adjusted by operation of the extraction means 62 and the pump means 58. Since the pressure boosting means 54 only has to raise the water pressure a relatively small amount from substantially that in reaction stage(iii) to substantially that in stage(i) the amount of pumping energy utilized in the pressure boosting means 54 and thus the operational costs thereof may be low. Any hydrate returned in the re-circulated water to the pressure vessels A1 to A6 may act as nuclei to assist the formation of more hydrate.

The separated hydrate which may still be in slurry form is cooled by cooling means 64 to a temperature just above the freezing point of its water component and then enters depressurisation means 66 where the pressure is reduced and the slurry supplied to second separation means 68 for the rigorous separation of water from the hydrate, the extracted water leaving via piping 70. The dried hydrate is finally conveyed at relatively low pressure, for example about atmospheric pressure, by cooled conveying means 72 to a storage area or means of transportation 74. Alternatively the hydrate slurry emerging from the cooling means 64 may be de-pressurised to a pressure suitable for the storage of the liquid slurry in a pressurised storage vessel. The un-reacted gas emerging from the pressure vessel A6 through pipe d6 is supplied to gas expansion means 76 and the expanded gas is fed through pipe 78 to gas combustion and utilization means 80 whereby the heat energy is used to produce motive and/or steam energy and/or electrical energy for powering pumps and/or other apparatus associated with or forming part of the plant.

The removal of a stream of un-reacted gas from the final pressure vessel A6 is necessary where there is a proportion of non-hydrate forming substances in the gas supply to the process. The composition of this un-reacted gas flow may be adjusted by control of the feed gas flow rate from the pipe 30, pressures and/or temperatures in the pressure vessels A1 to A6, so that the un-reacted gas is suitable for combustion in known means which may be used to provide motive or electrical power for use in the hydrate manufacturing process. In some situations the amount of this flow of the un-reacted gas may differ from that required for combustion, for example to enhance the hydrate forming reaction by removal of excess non-hydrate forming substances from the pressure vessels.

If desired, the primary separation means 39 and piping 37 may be omitted and a respective primary separation means is provided in each pipe e1, e2, e3, e4, e5 and e6 instead. These primary separation means extract water from the hydrate slurry and respectively supply the extracted water to a manifold feeding the water into the piping 40 for re-circulation. The respective primary separation means each feed the separated hydrate (or more concentrated hydrate slurry) into a common manifold feeding into the piping 42.

Figure 6:
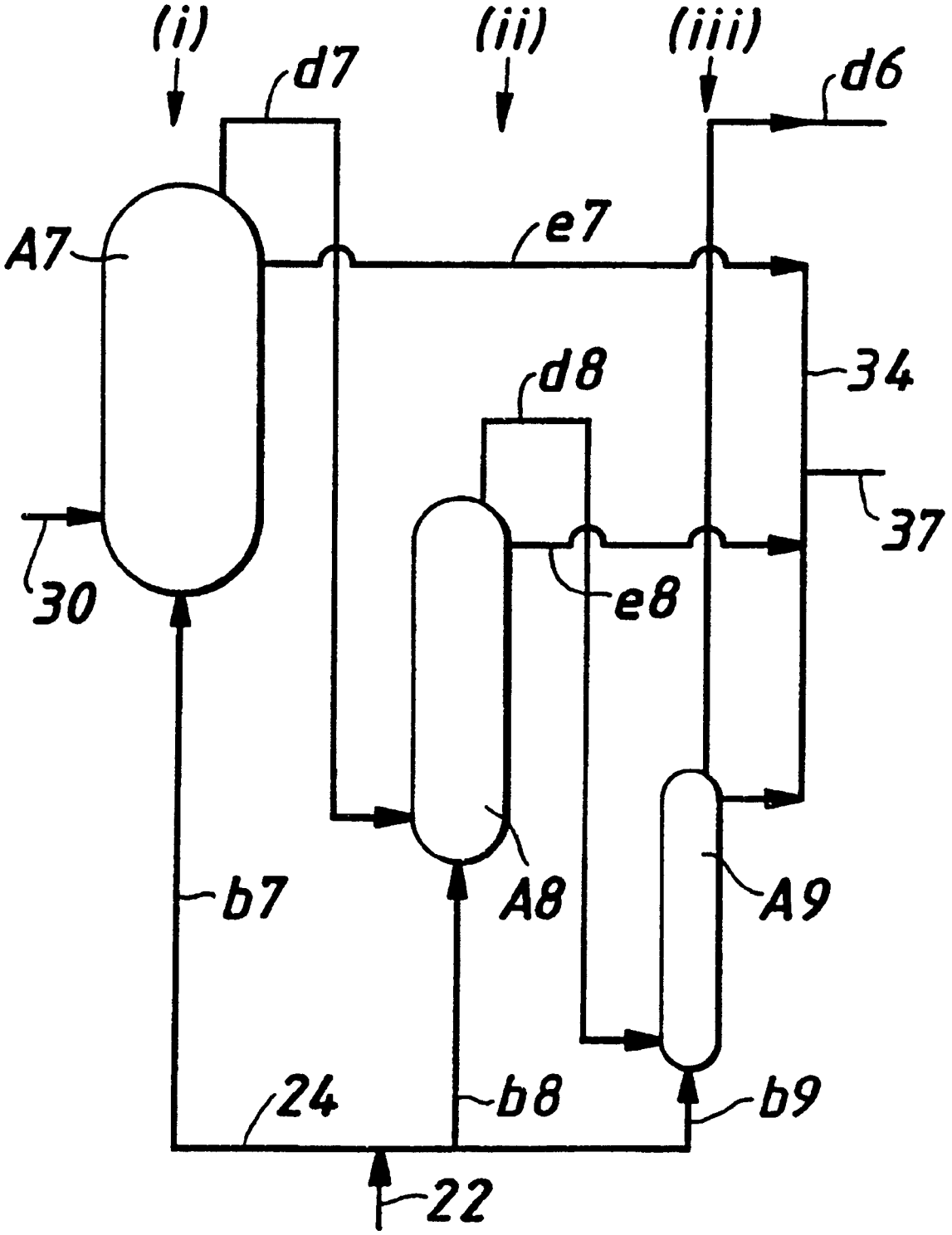
FIG. 6 shows diagramatically another array of such pressure vessels which can be substitutes for the array of pressure vessels in FIG. 5.

In FIG. 6 the pressure vessels of stages(i), (ii) and (iii) in FIG. 5 are replaced by three respective pressure vessels A7, A8 and A9. Water from the pipe 22 is supplied to the manifold 24 and then simultaneously through the pipes b7, b8, and b9 to the respective pressure vessels. The feed gas is supplied to the process through the pipe 30 and un-reacted gas is conveyed through pipes d7, d8 and the pipe d6. The produced hydrate slurry leaves the pressure vessels through pipes e7, e8 and e9 for the manifold 34. The cross-sectional areas of the pressure vessels A7, A8 and A9 are respectively sized so that in spite of gas being consumed in the vessels A7 and A8 the mean superficial upward velocity is the same in each of the pressure vessels A7, A8 and A9; the vessel A9 having the smallest cross-sectional area and the vessel A7 the largest cross-sectional area.

Figure 7:
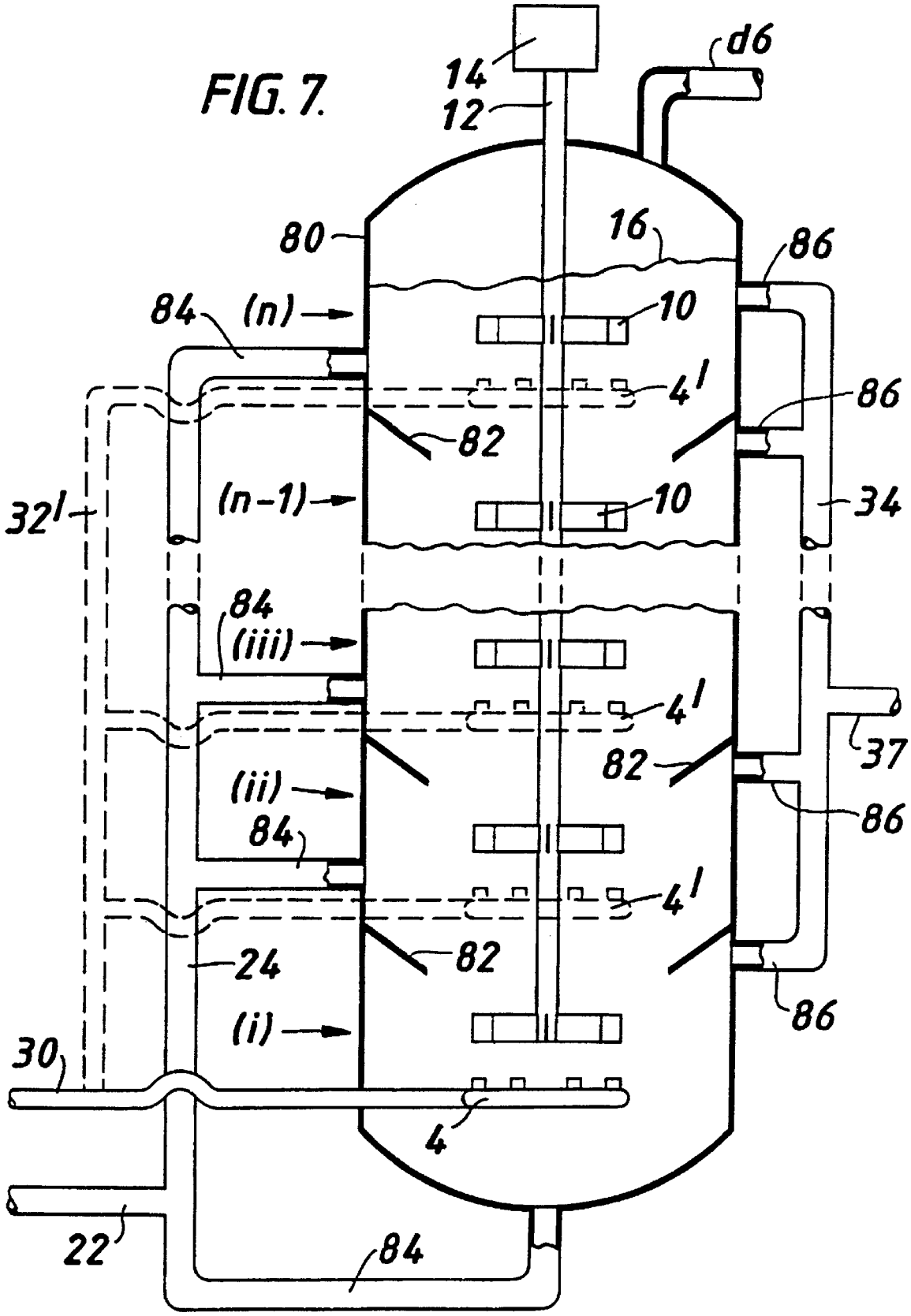
FIG. 7 shows diagramatically another embodiment of a pressure vessel which can be used in the method according to the invention and can be used as an alternative to the plurality of pressure vessels in the plant in FIG. 5.

Another form of pressure vessel is shown in FIG. 7 at 80. It is substantially a vertical cylinder internally comprising a plurality of hydrate forming regions or stages(i), (ii), (iii), . . . (n−1), (n), where n is a whole number, which can be of substantially equal size and are demarcated one from another by respective baffles 82 each of an open-ended, hollow, inverted-frustum shape attached to an internal wall of the vessel 80 and formed of perforate or mesh material allowing the passage of gas therethrough but not solids. Each stage is provided with its own driven agitator or bladed rotor 10 driven by the motor 14. The pressure vessel 80 can be substituted in FIG. 5 for the pressure vessels A1, A2, A3, A4, A5 and A6. Un-reacted gas leaves the pressure vessel 80 through the pipe d6. Water supplied by the pipe 22 to the manifold 24 is fed simultaneously, under pressure, into a lower part of each stage by a respective one of pipes 84. Hydrate is removed from an upper part of each stage through a respective one of pipes 86 which for the stages(i) to (n−1) open into the vessel 80 a little or just below the respective baffle 82 at the upper end of the stage concerned. The pipes 86 are connected to the manifold 34 feeding the piping 37. Natural gas from the pipe 30 is supplied under pressure to the nozzle 4. The un-reacted gas from one stage bubbles up to the next successive stage or stages and hydrate formed in the lower stages is entrapped by the baffles 82 and taken off through the pipes 86, whereas replacement reaction and cooling water is added to each stage through pipes 84.

If desired the pressure vessel may be provided with a respective gas supply nozzle 4' in each stage above stage (i) in FIG. 7. All the nozzles 4, 4' are supplied with gas from a manifold 32' fed with gas by the pipe 30. By feeding gas at substantially the same flow rate into each stage, the mean superficial upward velocity of the gas in each stage is substantially the same and may be substantially constant.

We claim:

1. A method of producing a gas hydrate from a hydrate forming gas and water, the method comprising:

passing the hydrate forming gas and water into a first hydrate forming region in which they are mixed under hydrate forming conditions to form hydrate of the gas, and passing residual hydrate forming gas which has not formed hydrate in said first hydrate forming region into at least one other hydrate forming region in which it is mixed with water under hydrate forming conditions and hydrate of the gas is formed and wherein the hydrate forming gas is bubbled upwardly through the water in each hydrate forming region.

2. A method as claimed in claim 1, in which there is a plurality of stages in which said hydrate is formed, one said stage comprises at least one said region, a successive said stage comprises at least another said region, the gas is supplied simultaneously to all the regions of a said stage when the latter comprises more than one said region and unreacted said gas from those regions is supplied simultaneously to all the regions of a successive said stage when that latter comprises more than one said region, and chilled water is supplied to all said regions simultaneously.

3. A method as claimed in claim 2, in which the mean upward superficial velocity of the gas flow in said stages is substantially the same.

4. A method as claimed in claim 3, in which said velocity is substantially constant.

5. A method as claimed in claim 2, in which a preceding said stage comprises at least two said regions and all those regions have a total cross-sectional area greater than the cross-sectional area of the reaction or the total cross-sectional area of all the regions of which the successive said stage is comprised.

6. A method as claimed in claim 2, in which a preceding said stage comprises a single first said region and a succeeding said stage comprises a single second said region, and the cross sectional area of the first said region is greater than that of the second said region.

7. A method as claimed in claim 1, in which each region is provided with agitation means to agitate the water in the regions.

8. A method as claimed in claim 1, in which each region is provided with baffle means extending upwardly.

9. A method as claimed in claim 1, in which each region is within a respective pressure vessel.

10. A method as claimed in claim 1, in which said regions are disposed one above another in a pressure vessel, the regions open one to another, the gas is bubbled upwardly through the water in said regions and each said region is a respective stage for hydrate formation at different levels in the vessel.

11. A method as claimed in claim 10, in which chilled water is introduced simultaneously into each region through a respective supply.

12. A method as claimed in claim 10, in which a gas permeable baffle means is disposed between adjacent ones of said regions to trap formed hydrate, and means is provided to take off the formed hydrate from each region.

13. A method as claimed in claim 10, in which the mean upward superficial velocity of the gas is substantially the same in all the stages.

14. A method as claimed in claim 10, in which each region is provided with a respective supply of gas from which supplies the gas bubbles upwardly through the water.

15. A method as claimed in claim 1, in which the water contains at least one freezing point lowering additive.

16. A method as claimed in claim 15, in which the water is sea water and said at least one additive is in the form of sodium chloride which occurs naturally in said sea water.

17. A method as claimed in claim 1, in which said hydrate in a slurry with water is taken off from at least one of said regions and at least some of this water is extracted from the slurry, said taking off and extraction is performed under a pressure commensurate with that in a said region and higher than atmospheric pressure so that the extracted water when recirculated to a said region does not have to be raised from atmospheric pressure to the pressure in the region receiving the recirculated water.

18. A method as claimed in claim 17, in which make-up water which has to be raised from substantially atmospheric pressure is added to the pressurized said extracted water.

19. A method as claimed in claim 1, in which residual hydrate forming gas from a said region is taken off and burnt to provide heat energy which is converted to driving power to drive apparatus used in a plant in which said method is performed.

20. A method of producing a gas hydrate as claimed in claim 1 in which the gas used is natural gas.

21. A method according to claim 1, in which said hydrate is taken off as a slurry from at least one of said regions and at least some of the water extracted from the slurry by primary separation means and the remaining hydrate slurry supplied to second separation means for the rigorous separation of water from the hydrate.

22. A method according to claim 1, in which the hydrate is stored in a pressurized storage vessel.

* * * * *